United States Patent [19]

Tyers

[11] 4,367,975

[45] Jan. 11, 1983

[54] TRAFFIC BARRIERS

[75] Inventor: Paul D. Tyers, Watford, England

[73] Assignee: Controlec Limited, Rickmansworth, England

[21] Appl. No.: 255,839

[22] Filed: Apr. 20, 1981

Related U.S. Application Data

[63] Continuation-in-part of Ser. No. 96,674, Nov. 23, 1979, abandoned.

[30] Foreign Application Priority Data

Nov. 23, 1978 [GB] United Kingdom ..... 45810/78

[51] Int. Cl.[3] ..... E01F 13/00

[52] U.S. Cl. ..... 404/6; 404/11; 49/35; 49/49; 49/131

[58] Field of Search ..... 404/6, 9, 11, 10; 49/49, 35, 93, 131, 132, 133, 134

[56] References Cited

U.S. PATENT DOCUMENTS

| | | | |
|---|---|---|---|
| 1,346,071 | 7/1920 | Vold | 404/9 |
| 1,649,877 | 11/1927 | Walston | 49/131 X |
| 2,024,063 | 12/1935 | Roper | 49/131 |
| 2,175,636 | 10/1939 | Morgan | 49/134 |
| 2,637,920 | 5/1953 | Stratton | 49/49 X |
| 2,657,486 | 11/1953 | Sweetser | 49/35 |
| 2,735,202 | 2/1956 | King | 49/49 X |
| 2,741,859 | 4/1956 | Castle | 49/49 |
| 2,917,283 | 12/1959 | Sumners | 49/49 X |
| 3,626,638 | 12/1971 | Lafferty | 49/49 |
| 3,748,782 | 7/1973 | Reynolds | 49/49 |
| 3,849,936 | 11/1974 | Geraci | 49/49 X |
| 4,097,170 | 6/1978 | Dickinson | 404/6 |

FOREIGN PATENT DOCUMENTS

| | | | |
|---|---|---|---|
| 367818 | 9/1933 | Italy . | |
| 2032983 | 5/1980 | United Kingdom | 49/49 |

*Primary Examiner*—James A. Leppink
*Assistant Examiner*—Beverly E. Hjorth
*Attorney, Agent, or Firm*—Brisebois & Kruger

[57] ABSTRACT

A traffic barrier comprises a step-like obstruction able to resist or prohibit the advance of a vehicle, a hinged platform disposed in advance of the step-like obstruction and rockable between a lowered position and a raised position, in which its trailing edge is adjacent the top of the step-like obstruction, spring means urging the platform into its raised position, latch means operable to lock the platform in its raised position to permit a vehicle to advance over the step-like obstruction, and control means including a coin-operated device or the like, for controlling the operation of the latch means.

In one embodiment, the latch means is normally in its released condition, and is actuated to lock the platform in its raised position when the prescribed parking fee is inserted into coin-operated device. The control means is responsive to advance of the rearmost wheels of the vehicle on to the top of the step-like obstruction to release the latch means and prevent advance of a following vehicle until the coin-operated device is tripped by the driver of the following vehicle.

In another embodiment, the latch means is normally retained in its latched condition, and the control means is responsive to the front wheels of a vehicle approaching the platform to release the latch means if the driver of that vehicle does not insert the prescribed parking fee in the coin-operated device.

21 Claims, 10 Drawing Figures

TRAFFIC BARRIERS

This is a continuation-in-part of Ser. No. 96,674 which was filed on Nov. 23, 1979, now abandoned.

The present invention relates to traffic barriers and, more particularly, although not exclusively, to traffic barriers for controlling the exits or entrances to car or vehicle parks.

Existing barrier constructions for controlling the flow of vehicle traffic generally comprise either a hinged arm, which is adapted to be lowered across the path of an approaching vehicle or, alternatively, a hinged or raisable step or plate, which is disposed at ground level and can be moved into a position to obstruct the wheels of an approaching vehicle.

It is customary to open such a barrier by lodging the appropriate fee in a coin-operated control mechanism or by actuating the control mechanism with a token, ticket or card. This effects opening of the barrier to permit passage of the vehicle which automatically actuates the control mechanism to close the barrier after it has negotiated the barrier.

In either type of existing barrier, the barrier, itself, is moved into its operative position by some form of motive device, such as, an electric motor or a hydraulic or pneumatic cylinder. The motive device is operated each time the barrier is opened and closed. When the barrier is used for a car park, the barrier and ancillary equipment are operated every time a vehicle is permitted to pass the barrier and this may require frequent actuation of the barrier and its ancillary equipment. Hence, existing barrier constructions require appreciable quantities of mechanical and electrical control equipment, may be subject to considerable wear, and tend to consume undesirable amounts of energy. A further disadvantage of existing constructions is that they do not reliably restrict the flow to one vehicle upon each operation of the barrier and can permit the unauthorised passage of an additional vehicle, when opened.

It is an object of the present invention to provide a traffic barrier which utilises simpler operating mechanism that hitherto known barriers, is less expensive to operate, and reliably restricts the flow of vehicles to one vehicle for each operation of the barrier device.

The invention consists in a traffic barrier comprising a step-like obstruction able to resist or prohibit the advance of a vehicle, a hinged platform disposed in advance of the step-like obstruction and rockable between a lowered position and a raised position in which its trailing edge is adjacent the top of the step-like obstruction, means urging the platform into its raised position, latch means operable to lock the platform in its raised position to permit a vehicle to advance over the step-like obstruction, and control means for controlling the latch means, said control means being responsive to advance of the vehicle relative to the barrier.

With the present invention, the platform is normally urged, for example, by spring means, into its raised position and there is no obvious, visible obstruction to the advance of a vehicle. When the prescribed action is taken, for example, by lodging the appropriate parking fee in a coin-operated control mechanism for the barrier, the platform is locked in its raised position to permit the vehicle to advance over the step-like obstruction. On the other hand, if the prescribed action is not taken, the platform is not locked in its raised position, and as soon as the vehicle moves on to the hinged platform, its weight depresses the trailing edge of the platform, which moves to its lowered position, so that the step-like obstruction is presented to the vehicle and prohibits its advance.

It will be appreciated that for every vehicle permitted to proceed past the barrier, the platform is locked in its raised position and there is consequently no movement of the barrier. In practice, the platform only moves on rare occasions, so that the barrier mechanism is subject to little wear, and the barrier only requires a small amount of energy to operate the latch means, thus resulting in a considerable reduction in operating and maintenance costs. When a vehicle has advanced from the platform, the control means may be actuated by the vehicle to release the latch means, or to condition the latch means for release, so that a following vehicle, for which the prescribed action has not been taken, will depress the platform and be obstructed by the barrier which, consequently, provides for strict control over the flow of vehicles.

Furthermore, the rate at which vehicles can negotiate a barrier according to the invention is appreciably greater than that for existing barriers since no delay is experienced in raising and lowering a barrier device. The speed of operation of a barrier according to the invention can be further increased, with a view to permitting vehicles to pass with a minimum of delay, by constructing the control means to accept payment of the prescribed fee or read a card or ticket whilst the preceding vehicle is still travelling over the platform.

In one embodiment of the invention, the step-like obstruction is arranged to project above an adjacent road surface and the platform is arranged as a ramp which leads from the road surface to the top of the obstruction, when in its raised position. A fixed ramp is disposed on the opposite side of the obstruction to the platform and extends downwardly from the obstruction to the road surface in order to permit a vehicle to return to the normal road surface after it has negotiated the barrier.

In another embodiment, the barrier may be disposed in an excavation in a road or track with the top of the step-like obstruction substantially level with the adjacent road surface and the platform, when in its raised position, also substantially level with this road surface.

Preferably, the step-like obstruction and the hinged platform are prefabricated as two separate units which can be installed in juxtaposed relation, either on on an existing road surface or in an excavation in the road, in order to construct the traffic barrier. For the former arrangement, the exit ramp from the barrier may also be manufactured as a prefabricated unit which can be installed contigously with the rearside of the unit forming the step-like obstruction.

The control means may include a coin, token, card or ticket-operated device positionable in advance of the hinged platform and responsive to the insertion of one or more prescribed coins or tokens or to the scanning of a prescribed ticket or card to actuate and lock the latch means, or maintain the latch means in its locked condition, so that the platform will be locked in its raised position. For releasing the latch means, or conditioning it for release, after a vehicle has advanced onto or past the step-like obstruction, the control means may include detecting means disposed on and/or adjacent the step-like obstruction and/or adjacent the barrier exit, responsive to the advance of the vehicle.

When the traffic barrier is located at the site where it must allow free flow of vehicles in the reverse direction, such as, at the common entrance and exit to a car park, the control means may include auxiliary detecting means disposed rearwardly of the step-like obstruction and arranged to detect the front wheels of a vehicle travelling in the reverse direction, whereupon to actuate and lock the latch means, or maintain the latch means in its locked condition, so that the platform will be locked in its raised position, thereby permitting unhindered flow of vehicles in said reverse direction.

Both the main and auxiliary detecting means may comprise actuating means movable by the wheels of a vehicle negotiating the barrier and adapted to actuate switch means. The latch means may comprise at least one solenoid-operated latch member mounted on the step-like obstruction and arranged to engage a cooperating detent on the platform, when the latter is in its raised position.

In one embodiment in which the latch means is normally maintained in its released condition until it is actuated due to the prescribed action being taken (for example payment of the prescribed parking fee), the main detecting means comprises actuating means mounted on the top of the step-like obstruction and movable by the wheels of a vehicle travelling on the top surface of the obstruction to actuate switch means which is responsive to movement of the actuating means by the rearmost wheels of the vehicle in order to release the latch means. The latch member may be controlled by two solenoid devices, one of which is adapted to advance the latch member into its locking position and the other of which is adapted to retract the first solenoid device and the latch member to their release positions. With this arrangement, only momentary energization of each solenoid device is required to move the latch member in opposite directions so that the energy consumption of the barrier is minimised.

In another embodiment, in which the latch means is normally maintained in its locking condition until an unauthorised vehicle (i.e. a vehicle, the driver of which has not taken the prescribed action) attempts to negotiate the barrier, the main detecting means comprises first actuating means mounted in advance of the platform, at or adjacent the leading edge thereof, and one or more further actuating means mounted rearwardly of the platform and/or step-like obstruction, the various actuating means being operable to actuate associated switch means. The switch means are responsive to movement of their respective actuating means by the front wheels of a vehicle. The switch means associated with the first actuating means is inhibited or isolated when the prescribed action is taken, so that actuation of the first actuating means by the front wheels of an authorised vehicle will not cause the first switch means to actuate and release the latch means, the first switch means being subsequently enabled or activated as a result of actuation of the further switch means due to actuation of the further actuating means by the front wheels of the authorised vehicle as the latter passes through the barrier. The latch member may be controlled by a single solenoid device which, when energised, retracts the latch member from its locking position against the action of return spring means. Energy consumption is also minimised with this arrangement, since the solenoid device is only energised when and for a relatively short predetermined period of time after, an unauthorised vehicle actuates the first actuating means.

Conveniently, the latch means is adapted to fail safe in that it will automatically lock the platform in its raised position when the electrical supply is switched-off or in the event of failure of the electrical supply.

A visual signal may be associated with the barrier in order to provide the driver of a vehicle with a visible indication of whether or not the platform is locked in its raised position and the vehicle is authorised to proceed. Such a visual signal may be in the form of conventional red and green traffic lights illuminated under the control of the control means. However, in some cases it may, alternatively or in addition, be desirable to provide an actual visible barrier in the path of travel of a vehicle negotiating the barrier, since the latter may not be apparent until unauthorised advance of a vehicle depresses the platform. Because a driver of a vehicle normally may see nothing to prevent him from negotiating the barrier, it is possible that he may be tempted to risk driving through the barrier without first paying the appropriate fee or taking other prescribed action. Accordingly, a visible barrier member, for example, in the form of a flap or board, may be mounted on the step-like obstruction and be operable by the control means so as to move into a visible and/or obstructing position on the top of the obstruction when the latch means is released or disengaged and to return to a concealed, or substantially concealed, and/or unobstructing position when a vehicle driver has taken the prescribed action to permit him to proceed. An audible alarm may additionally or alternatively be provided.

In order that the invention may be more readily understood, reference will now be made to the accompanying drawings, in which.

Figure 1:
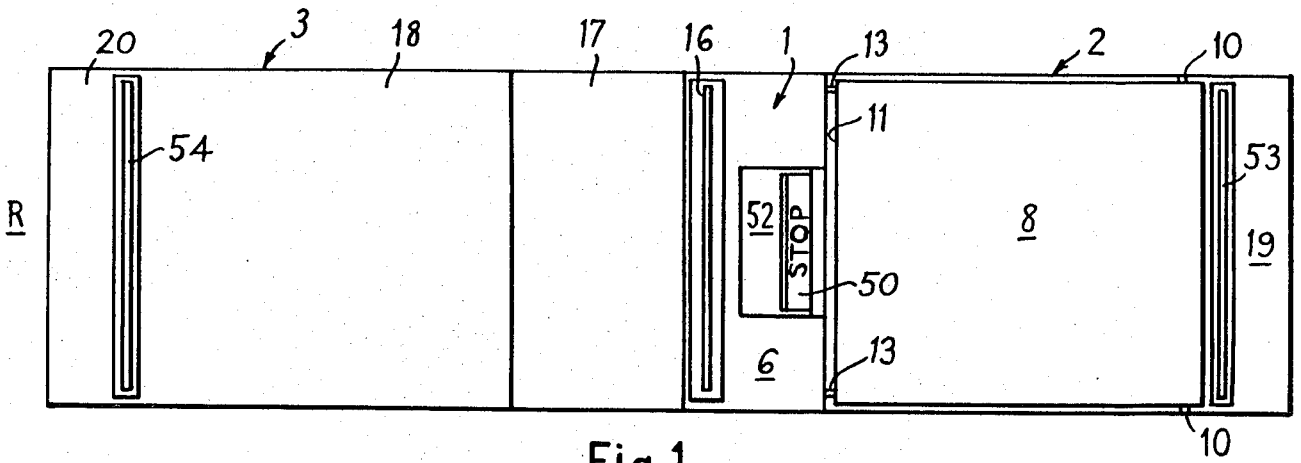
FIG. 1 is a plan view of one embodiment of the invention.
Figure 2:
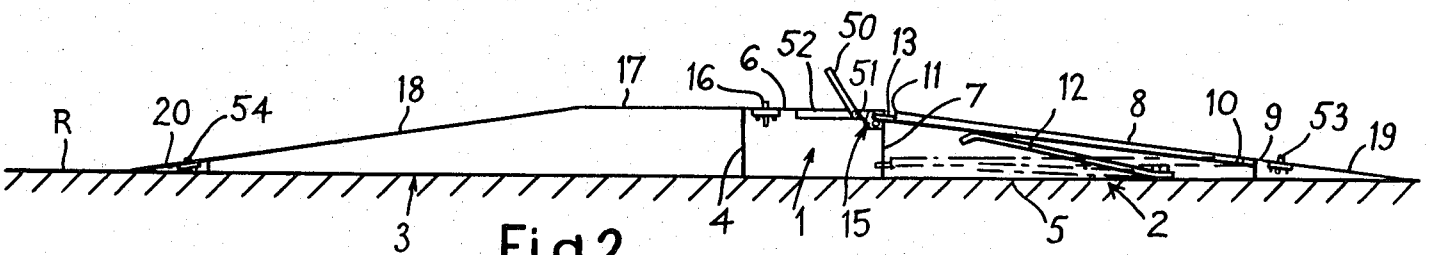
FIG. 2 is a schematic side elevation of the embodiment shown in FIG. 1.
Figure 3:
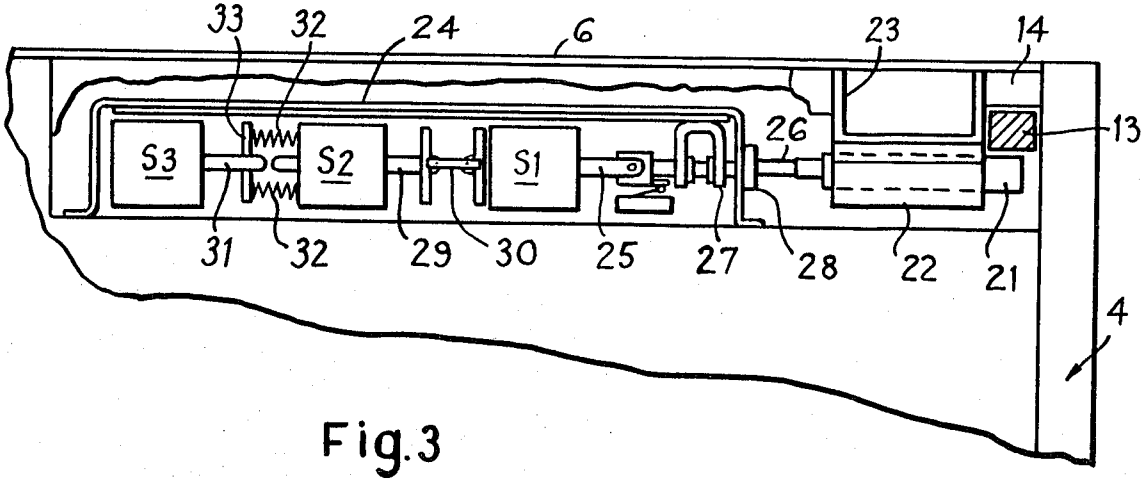
Figure 5:
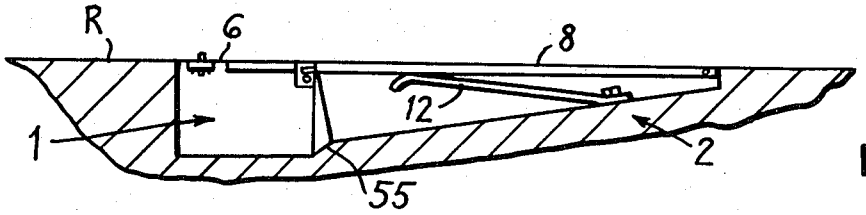
Figure 4:
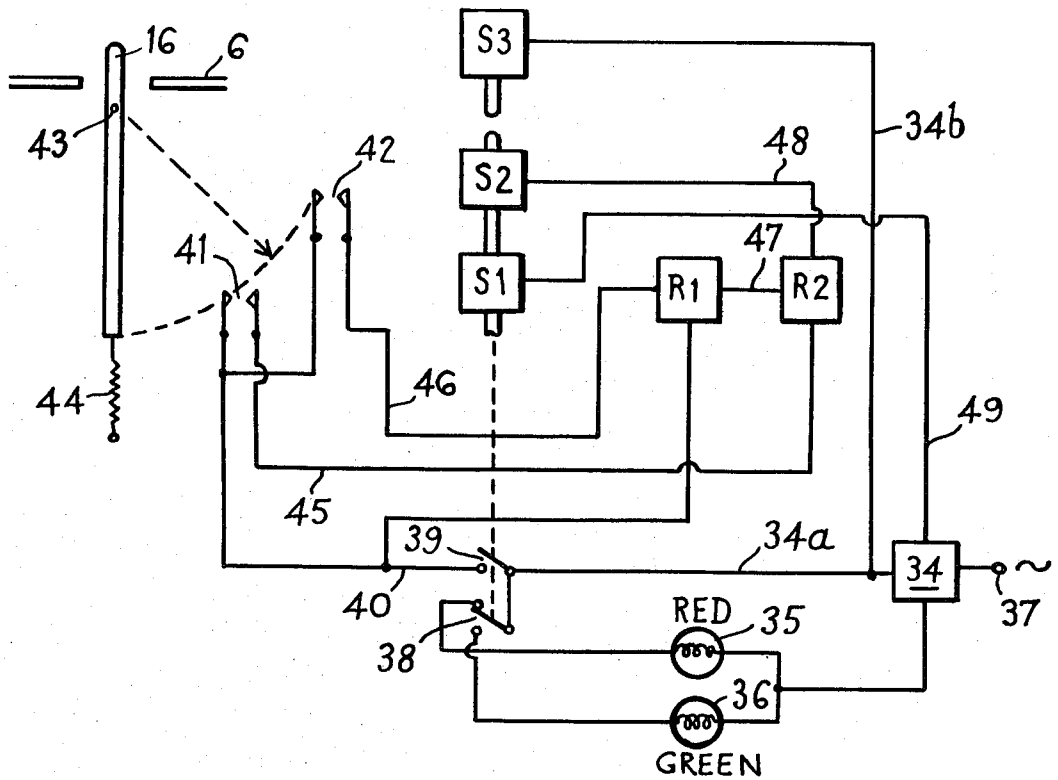
Figure 6:
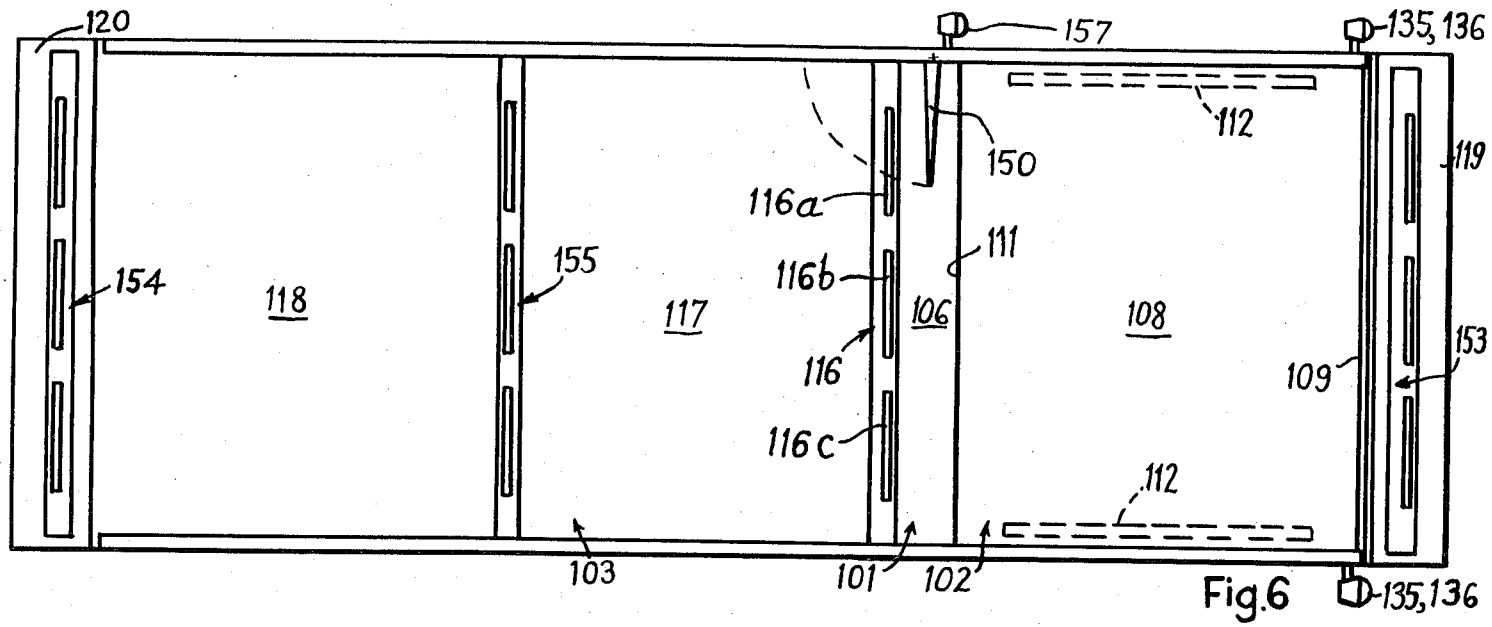
Figure 7:
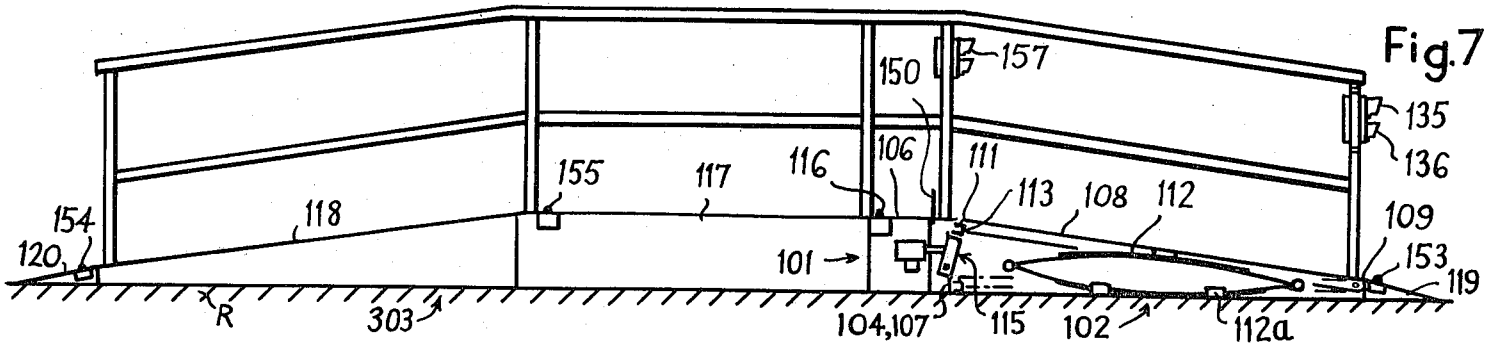

FIG. 3 is a fragmentary cross-sectional view, on an enlarged scale, illustrating a preferred form of the latch mechanism incorporated in the embodiment of FIGS. 1 and 2, FIG. 4 is a block schematic diagram of a preferred form of control circuitry for the barrier of FIGS. 1 to 3, FIG. 5 is a side elevation of a second embodiment, FIG. 6 is a plan view of a third embodiment of the invention, FIG. 7 is a schematic side elevation of the embodiment shown in FIG. 6

Figure 8:
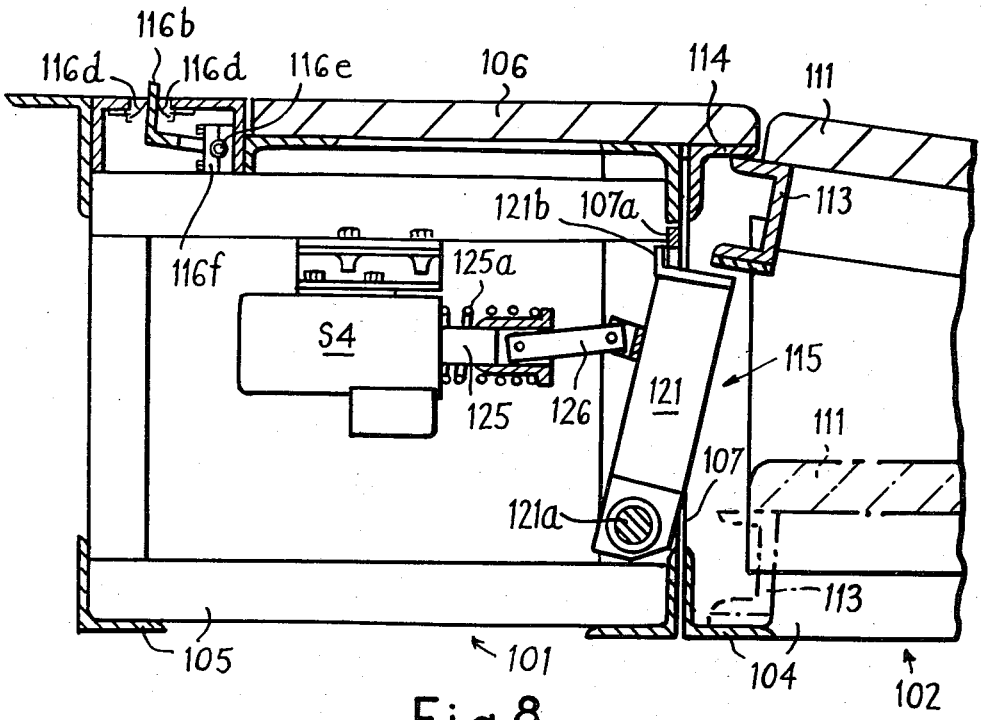
Figure 9:
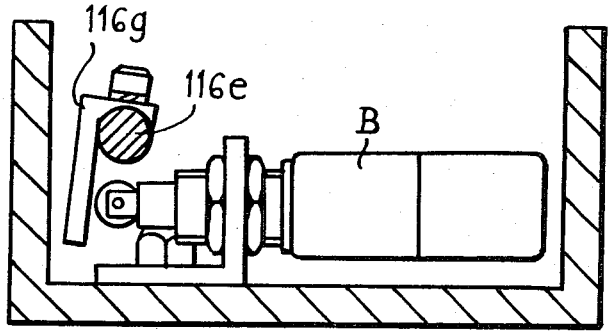

FIG. 8 is a fragmentary cross-sectional view, on an enlarged scale, illustrating a preferred form of the latch mechanism incorporated in the embodiment of FIGS. 6 and 7, FIG. 9 is a fragmentary cross-sectional view, on a more enlarged scale, illustrating the switch-actuating mechanism of one of the detecting means of FIGS. 6 to 8, and FIG. 10 is a block diagram of a preferred form of control circuitry for the barrier of FIGS. 6 to 9.

Referring to FIGS. 1 and 2 of the drawings, the traffic barrier is shown installed on a road surface R and comprises a central barrier or obstruction unit 1 in the form of a step-like obstruction, a hinged platform unit 2 disposed ahead of the step-like obstruction, and a fixed ramp unit 3 disposed rearwardly of the obstruction. The units 1 and 2 have metal supporting frameworks, indicated schematically in outline at 4 and 5, respectively, of any suitable construction, and the sides of the frameworks may be suitably encased with cladding (not shown). The unit 1 has a top surface 6, over which a vehicle may travel, and a solid front wall 7 which together form the step-like obstruction. The hinged platform unit 2 is constructed as a ramp and comprises a platform 8 hinged, at or adjacent its leading edge 9, to its supporting framework 5 by trunnions 10. The trailing edge 11 of the platform is disposed closely adjacent the front wall 7 of the step-like obstruction and the platform is rockable about the trunnions 10 from a lowered position, in which its trailing edge 11 is located adjacent the bottom of the front wall 7 to a raised position in which the trailing edge is substantially level with the top surface 6 of the obstruction. The platform 8 is urged into its raised position by heavy duty leaf springs 12 located adjacent opposite sides of the platform. Each of these leaf springs is bolted at one end to the supporting framework 5 and, at its opposite ends, bears against the underneath of the platform 8. The platform is indexed in its raised position by detent members 13 disposed at opposite ends of its trailing edge 11 which engage underneath frame members 14 of the obstruction unit 1 (see FIG. 3). Mounted at opposite sides of the obstruction unit adjacent the top of its front wall 7 are two latch mechanisms, generally indicated at 15, which are engagable underneath the detents 13, when these are in abutting relation with the frame members 14, to lock the platform in its raised position, as will be more fully described hereafter. Mounted adjacent the rear side of the obstruction unit and extending substantially across the full width of this unit so as to lie in the track of a vehicle travelling over the unit 1 is a detecting mechanism, which includes a switch 16 and which will also be more fully described hereafter, for controlling release of the latch mechanisms 15 after a vehicle has negotiated the barrier.

The fixed ramp unit 3 may be constructed in situ or may be prefabricated. It comprises a horizontal surface portion 17 contiguous with the top surface 6 of the unit 1 and leading to a downwardly extending ramp portion 18 via which vehicles travelling over the barrier return to the normal road surface R on which the barrier is installed. If necessary, short lead-in and lead-out sections 19,20 may be installed at the leading and trailing ends of the units 2 and 3, respectively, to afford smooth travel of a vehicle from the normal road surface R on to the barrier and vice versa.

At the site where the barrier is installed, suitable arrangements are made to ensure that a vehicle travelling along the road R controlled by the barrier, from right to left, as viewed in FIGS. 1 and 2, must proceed via the barrier units. The latter are made of adequate width to accommodate any vehicle expected to use the barrier. The horizontal surface at the apex of the barrier formed by the top surface 6 of the unit 1 and the contiguous surface portion 17 of the fixed ramp unit 3 enables the ramp units 2,3 and, hence, the overall barrier, to be kept reasonably short, whilst providing an adequate depth for the front wall 7 of the obstruction unit 1, without risk of the underside of a vehicle wedging against the apex of the barrier.

Referring to FIG. 3, each latch mechanism 15 includes a latch member 21 slidably mounted in a housing 22 secured to the underneath of a frame member 23 of the obstruction unit 1 adjacent the path of movement of the associated detent 13 on the platform. The latch member is actuated by two solenoids S1,S2 connected in series and disposed in a protective housing 24 secured below the top surface of the unit 1. The latching solenoid S1 has its armature 25 linked to the adjacent end of the slidable latch member 21 by a coupling rod 26 which is slidably mounted in a bracket 27 supported inside the housing 24 and which projects through a gasket 28 located at the adjacent end of the housing. The rod 26 is pivotally connected at its opposite ends to the armature 25 and the latch member, respectively. The releasing solenoid S2 is adapted to retract the armature 25 and the latch member from their locking positions. It is mounted rearwardly of the solenoid S1 and has its armature 29 connected to the rear end of the armature 25 by a link 30 so that the solenoids are coupled in series. Mounted in the housing 24 rearwardly of the solenoid S2 is a fail-safe solenoid S3. The armature 31 of the latter is aligned with the armature 29 of the solenoid S2 and is resiliently urged towards the adjacent, rear end of the armature 29 by tension springs 32 connecting a yoke 33, secured to the armature 31, to the casing of the solenoid S2. When the electrical current is switched on and the barrier is operating normally, the armature 31 of the solenoid S3 is retracted to permit the armature 29 to reciprocate freely as the latch member 21 is advanced and retracted by the solenoids S1 and S2. When the current is switched-off, or there is a failure in the electrical supply, the armature 31 is urged against the armature 29 by the springs 32 and drives the armature 29 and, in turn, the armature 25 and the coupling rod 26, in a direction to slide the latch member 21 into its locking position, where it is retained by the springs so as to hold the platform in its raised position and prevent the inoperative barrier from obstructing flow of vehicles.

The operation of the barrier will now be described in conjunction with FIG. 4 which schematically illustrates one form of control circuitry for the barrier. The particular circuitry illustrated is intended for controlling the barrier when installed at the entrance or exit to a car park. It includes a coin-operated switch device 34 housed in a cubicle or meter (not shown) located ahead of the hinged platform unit 2 of the barrier, in a convenient position for insertion of the prescribed parking fee by the driver of a vehicle wishing to negotiate the barrier. Red and green traffic lights 35,36 are also located in a convenient position to be observed by the driver to signal the driver when the platform is locked in its raised position and he is authorized to proceed. The device 34 is connected to a convenient alternating current supply 37 and, when this is switched-on to permit the barrier to operate, the fail-safe solenoids S3 are energized, via the lines 34*a*,34*b*, so that the armatures 31 are retracted, and the solenoids S2 are momentarily energized so that the latch members 21 are retracted from their locking positions. The red traffic light 35 is illuminated via a double pole microswitch 38 which is connected to the line 34*a* and is arranged to be actuated by the armature 25 of one solenoid S1 (see FIG. 3). The platform 8 is now in the unlocked condition and, if a vehicle driver attempts to drive his vehicle through the barrier without first lodging the required fee in the coin controlled mechanism, the platform 8 will be depressed by the weight of the vehicle to the position shown in broken lines in FIG. 2 and continued advance of the vehicle will be opposed by the physical size of the obstruction presented by the front wall 7 of the step-like obstruction 1. In order to negotiate the barrier, the vehicle driver must insert the prescribed parking fee in the coin controlled device 34, whereupon the latter momentarily energizes the latching solenoids S1, via the line 49, so as to advance the latch members 21 and lock the platform in its raised position. Simultaneously, movement of the armature 25 of the one solenoid S1 actuates a microswitch 39, which is juxtaposed the microswitch 38, so that the electrical supply is connected, via the line 40, to the two sets of switch contacts 41,42 controlling release of the latches, and enables the relay R1 for this purpose. It also actuates the microswitch 38 to switch-off the red traffic light and illuminate the green light, thereby authorising the driver to proceed. When the vehicle has advanced onto the top 6 of the step-like obstruction and its rear wheels have left the platform 8, the latches must be released to prevent passage of a subsequent vehicle. This is effected by the switch actuating bar 16 in conjunction with the two sets of switch contacts 41,42. The actuating bar 16 is hinged about an axis 43 extending transversely to the step-like obstruction with its top edge projecting above the top surface 6 of the obstruction so as to be engageable by the wheels of a vehicle travelling over this surface. The actuating bar is resiliently urged into an upright position by one or more tension springs 44 connected to the lower edge of the bar. When the front wheels of the vehicle engage the actuating bar, it is rocked in an anticlockwise direction, as viewed in FIG. 4, and the bar sequentially closes the switch contacts 41,42. The switch contacts 41 are connected, via a line 45, to energize a relay R2 which actuates the release solenoid S2. The switch contacts 42. via a line 46, control energization of the relay R1 which, in turn, enables the relay R2. Hence, when the switch contacts 41 are triggered for the first time upon movement of the front wheels of a vehicle over the actuating bar 16, these contacts are isolated from the solenoid S2 and the latter is therefore not energized and the latches remain in their locking positions. When the actuating bar subsequently triggers the switch contacts 42, the relay R1 is energized to enable the relay R2, via the line 47, and is retained in this condition by associated hold-in contacts. When the front wheels of the vehicle disengage the actuating bar, it returns to its upright position, permitting the switch contacts 42 to open. This has no affect because the relay R1 is maintained energized via its hold-in contacts and the switch contacts 41 are operable only unidirectionally so that the return movement of the actuating bar does not close these latter switch contacts. The control circuitry is now conditioned to release the latches and, when the rear wheels of the vehicle engage the actuating bar 16 and the switch contacts 41 are again triggered, the relay R2 is energized. The latter is retained in this condition by associated hold-in contacts and, in turn, energizes the solenoids S2 which retract the latch members 21 and unlock the platform. As the latch members and solenoid armatures 25 are retracted by energization of the solenoids S2, the microswitches 38,39 are restored to their initial positions so that the electrical supply is immediately disconnected from the switch contacts 41,42 and the relays R1,R2, which are de-energized, and the green traffic light is switched-off whilst the red light is switched-on to indicate to a following vehicle that the barrier is closed and that it is not authorised to proceed.

It is desirable that the barrier should be capable of operating as rapidly so as possible so as to allow vehicles to pass with minimum delay. The maximum speed of operation of the barrier can be increased by enabling prepayment of the parking fee while the preceding vehicle is still advancing over the platform 8. It is customary to operate existing car park barriers with what is commonly known in the art as a coin verifier or coin rejector. In such equipment, the coins inserted into the parking meter travel down an inclined chute into the coin verifier. The device 34 may include a coin verifier of known type but modified so that, as soon as the coins operate the latch mechanisms, upon successfully passing through the verifier, an auxiliary switch is arranged to actuate a gate in the coin chute when then enables coins to be lodged in the chute by the next vehicle driver. At the moment the preceding vehicle triggers the switch to disengage the latch mechanisms, the switch also operates and opens the gate to permit the coins to enter the verifier, whereupon the latch mechanisms are again actuated. The next vehicle can therefore commence to advance over the hinged platform before the preceding vehicle has completely negotiated the barrier.

In cases where the traffic light signals 35,36 are not considered a sufficient guide or deterrent to prevent the driver of a vehicle from attempting to negotiate the barrier, a visible, physical barrier may be provided. In the embodiment illustrated in FIGS. 1 and 2, this takes the form of a plate or board 50 provided with suitable markings to enhance its visibility and mounted on the obstruction unit 1. The board 50 is mounted on hinges 51 in a cavity 52 in the top surface 6 of the unit 1 so that, when the barrier is closed, it is rocked into the upright position shown in FIG. 2 where it is visible to a vehicle driver, and is concealed in the cavity 52 when the driver is permitted to proceed. The board 50 may be actuated by a solenoid device (not shown) appropriately connected in circuit with the red and green traffic lights 35,36.

In some installations, the barrier may be required to control the flow of vehicles in one direction whilst permitting free flow of vehicles in the reverse direction, for example, as in a car park having a single road or track for both entrance and exit to the car park. The auxiliary detecting means required to provide this facility is illustrated in FIGS. 1 and 2. Hence, for movement of vehicles from right to left, as viewed in these figures, the barrier operates as previously described. However, the barrier must permit free flow of traffic in the reverse direction, that is from left to right, and, when a vehicle travels across the barrier in this direction, the platform 8 must therefore be automatically locked in its raised position. This is achieved by installing two auxiliary switch actuating bars 53,54 and associated switch mechanisms in the lead-in and -out sections 19,20. When a vehicle travels from left to right over the barrier and its front wheels engage the actuating bar 54, this is arranged to trigger a single switch connected to the locking solenoids S1 so as momentarily to energize the latter and lock the platform in its raised position. The latches are then subsequently released by operation of the actuating bar 53 as the vehicle moves off the platform 8. The actuating bar 53 and associated switch mechanism may be similar to the actuating bar 16 and its associated switch contacts so that the latches are only released when the rear wheels of the vehicle engage the bar 53. The actuating bars are adapted to trigger their associated switch mechanisms only upon engagement by a vehicle travelling from left to right over the barrier. When a vehicle negotiates the barrier in the opposite direction, the switch mechanisms remain unactuated.

FIG. 5 illustrates another embodiment in which the barrier is installed level with the road surface R instead of as a ramp projecting above it. In this embodiment, the unit 1 forming the step-like obstruction and the hinged platform unit 2 are installed in an excavation 55 in the road so that the top surface 6 of the unit 1 and the platform 8 are level with the adjacent road surface. This arrangement of the barrier operates and may be controlled in a similar manner to the embodiment described with reference to FIGS. 1–4.

The barrier shown in FIGS. 6 and 7 is similar, in many respects, to that shown in FIGS. 1 and 2, and only the significant differences will be described in detail.

As will be seen from FIGS. 6 and 7, the platform 108 is urged into its raised position by heavy duty spring means comprising double-elliptical leaf spring units 112 located adjacent opposite sides of the platform. Each of these units comprises upper and lower elliptical leaf springs pivotally interconnected at opposite ends. The upper spring is bolted at its centre to the underside of the platform 108, and the lower spring slidably bears against the supporting framework 105 and is laterally located by guide blocks 112*a*. The double-elliptical spring units possess the advantage that they provide substantially uniform resistance over the normal range of hinging movement of the platform 108.

The platform is indexed in its raised position by a detent member comprising a tranversely extending U-section beam 113 secured beneath and projecting rearwardly of the trailing edge 111 of the platform, which engages underneath a transverse fixed frame member 114 of the framework of the platform unit 102 (see FIG. 8). Mounted towards opposite sides of the obstruction unit 101 and projecting through its front wall 107 are two latch mechanisms, generally indicated at 115, which are engageable underneath the beam 113 when the latter is in abutting relation with the frame member 114, to lock the platform in its raised position, as will be more fully described hereafter. These latch mechanisms are preferably disposed approximately beneath the path of the wheels of a vehicle negotiating the barrier.

Short lead-in and exit or lead-out ramp sections 119, 120 are installed at the leading and trailing ends of the units 102 and 103, respectively, to afford smooth travel of a vehicle from the normal road surface R on to the barrier and vice-versa. The lead-in section 119, obstruction unit 101, fixed ramp unit 103 and lead-out section 120 are each provided with detecting means including respective pressure-sensitive switch actuators 153, 116, 155 and 154. Each actuator extends substantially across the full width of its associated unit so as to lie in the track of a vehicle travelling over the barrier. The detecting means, which will be more fully described hereafter, serve to control operation of the latch mechanisms 115 and signals, etc., associated with the barrier.

Referring to FIG. 8 each latch mechanism 115 includes a latch member 121 pivotally mounted on pins 121*a* secured to the base of the frame of the front wall 107 of the obstruction unit 101. The latch member is actuated by a solenoid S4 disposed in a protective housing secured below the top surface of the unit 101. The latching solenoid S4 has its armature 125 linked to the pivotable latch member 121, towards the upper end thereof, by a coupling rod 126, and a compressed coil spring 125*a* surrounding the armature normally urges the latter to an extended position in which the latch member 121 projects through the front wall to the position shown, limited by the engagement of a stop 121*b* on the latch member with a stop 107*a* on the front wall of the unit 101. In this position, corresponding to the de-energised condition of the solenoid S4, the latch member 121 extends beneath the underside of the beam 113 at the trailing edge 111 of the hinged platform to support and positively lock the latter in its raised position, and allow vehicles to pass across the barrier. When the solenoid S4 is energised, the armature 125 will be retracted against the action of the spring 125*a*, retracting the latch member 121 from beneath the beam 113, thus releasing the platform for downward hinging movement against the action of the double-elliptical spring units 112 should a vehicle attempt to pass across the barrier.

FIG. 8 also shows the switch actuator 116 of the detecting means associated with the obstruction unit 101. The detecting means associated with the various ramp units and sections are effectively the same, and only the construction of the former means will therefore be described. The switch actuator 116 comprises three transversely spaced L-section members (116*a*, 116*b* and 116*c* in FIG. 6) only one of which, namely member 116*b* is visible in FIG. 8. One end of each member projects upwardly, through a bristle or brush seal device 116*d* or other suitable sliding seal, for engagement and depression by the wheels of a vehicle negotiating the barrier, and the other end is fixed to a transversely extending common rod 116*e* rotatably mounted in transversely spaced bearings, one of which is shown at 116*f*. As shown in FIG. 9, an L-section arm 116*g* is fixed to one end of the rod 116*e*, adjacent one side of the obstruction unit 101, the arm being cooperable with a switch B to actuate and close the latter when the rod 116*e* is rotated by depression of the actuator member 116*a*, 116*b* and/or 116*c*. The elements 116, 116*e* and 116*g* are normally spring biased to their position shown, and this may, for example, be achieved by one or more resilient bushes (not shown) of known type, such as bushes identified by the trade mark "Metalastic". The or each bush is mounted on the rod 116*e*, and has a resilient tubular element, the internal periphery of which is fixed relative to the rod 116*e*, and the external periphery of which is fixed relative to the framework of the obstruction unit 101 in an angularly adjusted and adjustable position such that the elements normally assume their positions shown.

Figure 10:
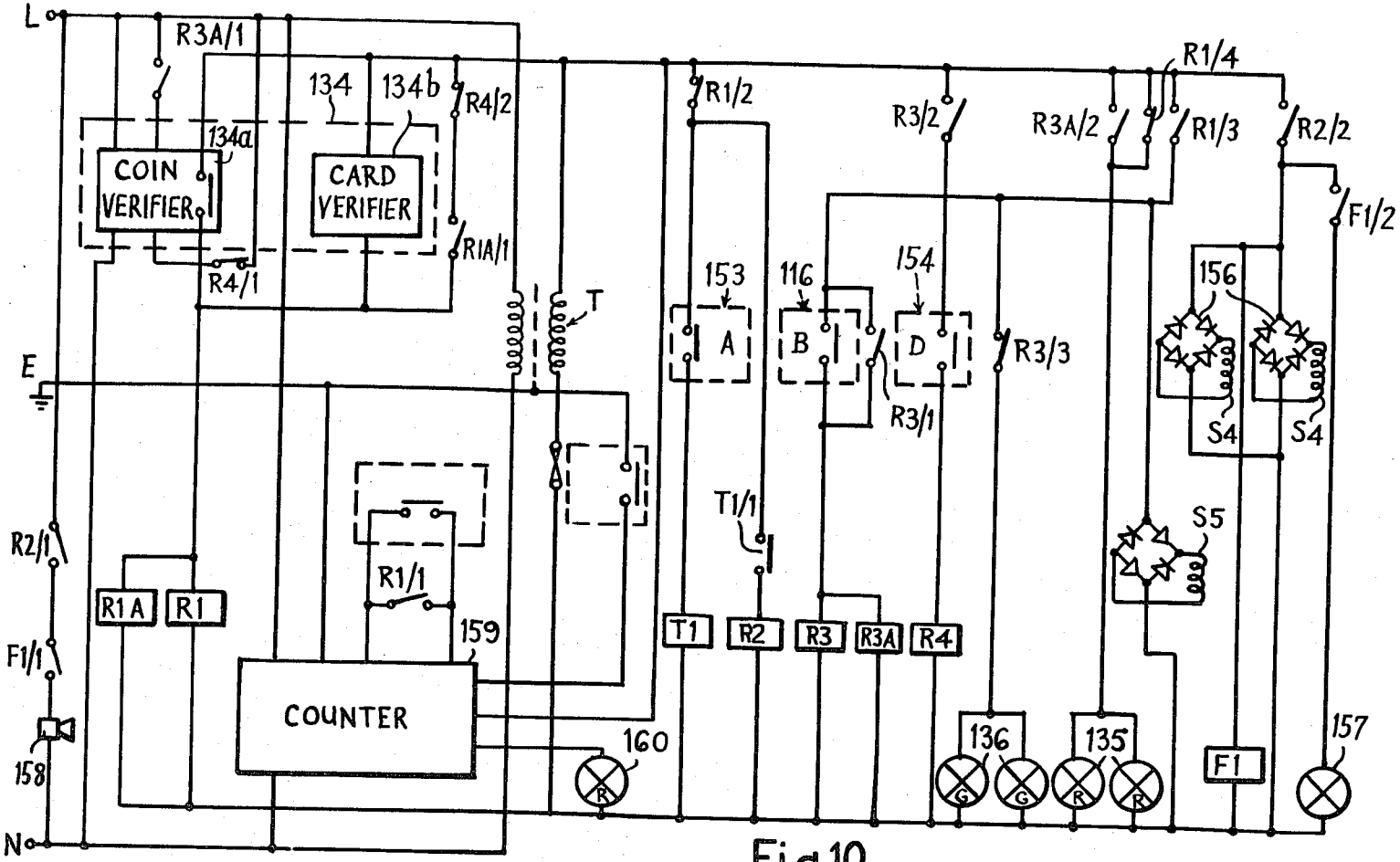

The operation of the barrier of FIGS. 6 to 9 will now be described in conjunction with FIG. 10 which schematically illustrates one form of control circuitry for the barrier. The particular circuitry illustrated is intended for controlling the barrier when installed at the entrance or exit to a car park. It includes a coin-operated switch device 134 including a coin-operated mechanism and coin verifier 134*a* and a card-operated mechanism 134*b*, the device 134 being housed in a cubicle or meter (not shown) located ahead of the hinged platform unit 102 of the barrier, in a convenient position for insertion of the prescribed parking fee, card etc., by the driver of a vehicle wishing to negotiate the barrier. Red and green traffic lights 135, 136 are also located in a convenient position to be observed by the driver to signal the driver whether or not the platform is locked in its raised position and he is authorised to proceed. The device 134 is connected to a convenient alternating current supply for example a conventional 240 volts main supply. For reasons of safety, this supply terminates at the cubicle or meter, and all of the electrical components mounted in or on the barrier are supplied with 24 volts a.c. via a transformer T. When this supply is switched on to permit the barrier to operate, the various relays and switches are in their positions shown. The red traffic lights 135 are illuminated via normally closed contacts R1/4 of de-energised relay R1 connected in series with the coin/card operated switch device 134. Switches A, B and D actuable by the pressure-sensitive switch actuators 153, 116 and 154 respectively, and also the switch (not shown) actuable by actuator 155, are open. Switch A is connected in series with normally closed relay contacts R1/2 of relay R1, and with a timer T1. The timer has normally open contacts T1/1 connected in series with relay R2, the latter relay have normally open contacts R2/2 connected in series with the mutually parallel-connected energising bridge-rectifier circuits 156 of the solenoids S4 of the latch mechanisms 115. The solenoids S4 are therefore de-energised and their associated latch members 121 lock the platform 108 in its raised position.

If a driver now attempts to drive his vehicle through the barrier without first lodging the required fee, or card, in the coin/card-operated device 134, the front wheels of the vehicle will initially contact and depress switch actuator 153 in the lead-in ramp section 119, closing switch A, and completing the energising circuit to timer T1 via closed relay contacts R1/2. Timer contacts T1/1 are immediately closed, which energises relay R2, closes relay contacts R2/2, and energises latch solenoids S4, thus retracting and releasing both latch members 153. Closed contacts R2/2 also energise a flasher relay F1 which repeatedly opens and closes contacts F1/2 to intermittently illuminate a visible "REVERSE AND PAY" sign 157. Relay contacts R2/1 are also closed and flasher unit contacts F1/1 are intermittently closed to intermittently complete a series-energising circuit to an audible alarm 158. When the front wheels pass forward over and off the switch actuator 153 of the switch A, onto the platform 108, the platform is depressed by the weight of the unauthorised vehicle compressing the spring units 112, to the position shown in broken lines in FIGS. 6 and 7. Continued advance of the vehicle will be opposed by the physical size of the obstruction presented by the front wall 107 of the step-like obstruction unit 101, and the transverse upper frame member 114 (FIG. 8) which buts against the front wall. Release and opening of the switch A starts the timer T1, and at the end of a predetermined period, the timer stops, contacts T1/1 open to de-energise relay R2, contacts R2/2 open to de-energise latch solenoids S4, and latch members 121 return to their locking positions under the effect of their return springs 125*a*. Flasher relay F1 is also de-energised and contacts F1/2, F1/1 and R2/1 are opened, switching off the "REVERSE AND PAY" sign 157 and the alarm 158. When the driver reverses his vehicle off the depressed platform 108, the spring units 112 will elevate the platform to its raised position, cammingly over-riding and momentarily depressing the latch members 121 if the timer T1 has already stopped and the latch members have consequently been returned to their locking positions.

In order to negotiate the barrier, the driver must insert the required parking fee or card in the device 134, whereupon the latter energises relay R1, thus opening contacts R1/4 to switch off the red traffic lights 135 and closing contacts R1/3 to switch on the green traffic lights 136. In addition, contacts R1/2 open, so that when the front wheels of the vehicle pass over the switch actuator 153, and close switch A, timer T1 and latch solenoids S4 are not energised, and the latch members remain in their locked position, i.e. switch A is effectively inhibited or isolated. The vehicle is then able to pass up the raised and locked platform 108, the momentary closing of the switch A by the rear wheels, likewise, having no effect on the timer T1 due to the open contacts R1/2. When the front wheels run over the actuator 116 on the obstruction unit 101, the associated switch B is closed, energising relays R3 and R3A. Contacts R3/1 in parallel with switch B close to retain relays R3 and R3A energised after the wheels pass off the actuator 116, contacts R3/3 open to switch off the green traffic lights 136, contacts R3A/2 close to switch on the red traffic lights 135, and contacts R3/2 close to enable switch D of actuator 154 of the lead-out ramp section 120. The front wheels of the vehicle next pass over actuator 155 to close an associated switch (not shown) which serves to condition the coin/card operated device 134 to accept the parking fee or card of the driver of the next vehicle. This switch, instead of switch B, could alternatively serve to control relay R3 and enable switch D.

As the vehicle leaves the barrier, its front wheels momentarily pass over actuator 154 in lead-out ramp section 120, which closes associated switch D, energising relay R4. Contacts R4/1 and R4/2 associated with the coin/card-operated device 134 are opened, deenergising relay R1 which resets the barrier control circuitry or system to its initial condition.

When the front wheels of the vehicle actuate the actuator 116 on the obstruction unit 101 and enable the switch D, it will be apparent that the rear wheels of the vehicle will still be supported by the platform 108. If, at this stage, the switch D is closed and enables switch A, for example by the rear wheels of the preceding vehicle passing over the actuator 154 of the lead-out ramp section 120 as the vehicle leaves the barrier, or by a person treading on the actuator 154, and if the switch A is then closed, for example by the front wheels of an unauthorised vehicle passing over the actuator 153 of the lead-in section 119, or by a person treading on the actuator 153, the latch solenoid-energising circuit will be completed. However, the arrangement, for example the power or strength exerted by the solenoids S4, and/or the design or configuration of the latch means and detent member, is such that the weight of the vehicle applied via its rear wheels to the platform 108 will press the detent member or beam 113 (FIG. 3) down onto the latch members 121 with sufficient force to override the solenoids and ensure that the latch member 121 cannot move to their retracted positions until the rear wheels of the authorised vehicle pass off the platform 108 onto the top of the obstruction unit 101 and said force is removed. If, at that stage, the front wheels of a succeeding unauthorised vehicle are already on the platform 108, the weight of the latter will likewise prevent the latch members from releasing. However, the length of the platform 108 is arranged to be less than the minimum wheelbase of the normal range of vehicles intended to use the barrier. Thus, as the front wheels of the unauthorised vehicle pass onto the top of the obstruction unit 101, the rear wheels thereof will not have reached the leading-edge of the platform 108, the pressure on the platform will be removed, and the latch members will retract trapping the unauthorised vehicle spanning the released platform 108.

The coin/card operated device 134 is also associated with a counter 159 which, via relay contacts R1/1, counts the number of authorised vehicles passing through the barrier. This number is compared, in an appropriate manner, with the number of vehicles leaving the parking zone, to derive a count corresponding to the instantaneous total number of parked vehicles. When the parking zone is full, a further red light 160 indicating this fact is illuminated.

It is desirable that the barrier should be capable of operating as rapidly as possible so as to allow vehicles to passing with minimum delay. The maximum speed of operation of the barrier can be increased by enabling pre-payment of the parking fee while the preceding vehicle is still advancing over the platform 108. It is customary to operate existing car park barriers with what is commonly known in the art as a coin verifier or coin rejector. In such equipment, the coins inserted into the parking meter travel down an inclined chute into the coin verifier. The device 134 includes a coin verifier 134*a* of known type but modified so that, as soon as the coins energise the relays R1 and R1A, upon successfully passing through the verifier, an auxiliary switch is arranged to actuate a gate in the coin chute which then enables coins to be lodged in the chute by the next vehicle driver. At the moment the preceding vehicles triggers the switch D to enable the switch A, the auxiliary switch also operates and opens the gate to permit the coins to enter the verifier, whereupon the switch A is again inhibited. The next vehicle can therefore commence to advance over the hinged platform before the preceding vehicle has completely negotiated the barrier. The card verifier 134*b* operates in a somewhat analogous manner.

In cases where the traffic light signals 135, 136 are not considered a sufficient guide or deterrent to prevent the driver of a vehicle from attempting to negotiate the barrier, a visible, physical barrier may be provided. In the embodiment illustrated in FIGS. 1 and 2, this takes the form of a plate or board 150 provided with suitable markings to enhance its visibility and mounted on and to one side of the obstruction unit 101. The board 150 is mounted for swinging movement about a vertical axis, and is normally spring-biassed into a closed position in which it projects part way across the unit 101 as shown in FIG. 6, where it is visible to a vehicle driver. The board 150 may be swung out of the way by a solenoid S5 connected in series with relay contacts R1/3 so as to be energised when relay R1 is energised. Alternatively, the board 150 could be normally biassed into its open position, and only swung closed when its solenoid S5 is energised, for example by closure of the switch A when enabled, by an unauthorised vehicle.

In some installations, the barrier may be required to control the flow of vehicles in one direction whilst permitting free flow of vehicles in the reverse direction, for example, as in a car park having a single road or track for both entrance and exit to the car park. At least the actuator 155 on the fixed ramp unit 103 may, in this event, be utilized as the auxiliary detecting means required to provide this facility. Hence, for movement of vehicles from right to left, as viewed in these figures, the barrier operates as previously described. However, the barrier must permit free flow of traffic in the reverse direction, that is from left to right, and, when a vehicle travels across the barrier in this direction, the platform 108 must therefore remain locked in its raised position. This may be achieved by using the actuator 155 to inhibit, i.e. isolate or open-circuit, the switch A, and the lead-in actuator 153 and/or a timer to enable switch A and reset the system, when the rear wheels of the vehicle have passed off the platform 108.

Whilst particular embodiments have been described, it will be understood that modifications can be made without departing from the scope of the invention as defined by the appended claims.

For example, compression coil or tension springs may be utilised in place of the leaf springs for urging the platform into its raised position. When tension coils springs are utilised, there may be suspended from suitable framework projecting above the platform at opposite sides thereof. The leaf springs shown in the FIG. 7 embodiment may be used in the FIG. 2 or FIG. 5 embodiment, and vice-versa.

Moreover, whilst the invention has been particularly described for controlling the movement of vehicles having two axles, it will be appreciated that the barrier of FIGS. 6 to 10 will also operate satisfactorily with vehicles having additional axles. So far as the barrier FIGS. 1 to 4, or FIG. 5 is concerned, either by utilising additional switches and relays or logic circuitry operating in response to a predetermined number of impulses, this barrier can be adapted for use with vehicles having additional axles and so that, upon travel of such a vehicle past the barrier, the platform 8 will not be unlocked until the rearmost set of wheels engage the actuating bar 16. When the barrier is adapted to control the entrance or exit to a vehicle park intended also to be used by vehicles having more than two axles, the coin-operated control device 34 may include an additional coin slot for such vehicles, the insertion of the prescribed coinage into this additional slot switching-in supplementary control circuitry which prevents release of the latches until the rearmost axle of the vehicle has advanced off the hinged platform.

In the embodiment of FIGS. 6 to 10, the detecting means including the switch B and associated actuator 116, and/or associated circuitry, may be operable to reset the system, i.e. enable the switch A, when the rear wheels of the authorised vehicle advancing through the barrier pass over and actuate the actuator 116. For example, the first actuation of the actuator 116, which will be effected by the front wheels of the vehicle, may serve to switch the traffic lights from green to red, whilst the second actuation of the actuator 116, which will be effected by the rear wheels, may serve to enable the switch A.

The barrier illustrated in FIG. 5 may be controlled in a similar manner to that described with reference to FIGS. 6 to 10.

In the embodiments illustrated, for example in FIGS. 6 to 9, the platform unit 102, and in particular the transverse frame member 114 or equivalent, may constitute the obstruction or abutment means which resists passage of an unauthorised vehicle, in which event the unit 101, if provided, may merely serve as a platform latching unit. The actuator 153 could be carried by the leading-edge zone of the hinged platform 108, instead of being located in advance of the platform.

I claim:

1. A traffic barrier for controlling a flow of vehicles, comprising in combination:

(a) a step-like obstruction adapted to resist the advance of a vehicle, said step-like obstruction having a top and an abutment wall extending downwardly from said top;

(b) a platform disposed in advance of said step-like obstruction and having a leading edge remote from said obstruction and a trailing edge adjacent said abutment wall of said obstruction;

(c) hinge means mounting said platform for rocking movement between a lowered position and a raised position in which said trailing edge of said platform is adjacent said top of said step-like obstruction;

(d) means urging said platform into said raised position;

(e) said platform being depressible into said lowered position by a vehicle advancing over said platform from said leading to said trailing edge thereof, whereby said abutment wall of said step-like obstruction is presented to said vehicle to resist advance thereof;

(f) latch means movable between a release position and a locking position in which said latch means locks said platform in said raised position, whereby to permit a vehicle to advance over said platform and onto said top of said step-like obstruction;

(g) means adapted normally to retract said latch means into said release position;

(h) control means selectively operable to actuate said latch means and lock said platform in said raised position;

(i) said control means being responsive to advance of the rearmost wheels of a vehicle onto said top of said step-like obstruction to release said latch means.

2. A traffic barrier as claimed in claim 1, wherein said step-like obstruction is adapted to project above an adjacent road surface and said platform, when in said raised position thereof, is arranged as a ramp which leads from said road surface to said top of said obstruction, and wherein a fixed ramp is disposed on the opposite side of said obstruction from said platform and extends downwardly from said obstruction to said road surface in order to permit a vehicle to return to the normal road surface after it has negotiated said barrier.

3. A traffic barrier as claimed in claim 1, wherein said step-like obstruction and said platform are disposed in an excavation in a road, with said top of said step-like obstruction substantially level with the adjacent road surface, and said platform, when in its raised position, also substantially level with said road surface.

4. A traffic barrier as claimed in claim 1, wherein said step-like obstruction and said platform are prefabricated as two separate units which can be installed in juxtaposed relation in order to construct said traffic barrier.

5. A traffic barrier as claimed in claim 1, wherein said control means includes a manually operated device positioned in advance of said platform and responsive to a prescribed action to actuate said latch means and lock said platform in said raised position thereof.

6. A traffic barrier as claimed in claim 1, wherein said control means includes detecting means disposed on or adjacent said step-like obstruction and responsive to movement of the rearmost wheels of a vehicle on to said top surface of said obstruction to release said latch means.

7. A traffic barrier as claimed in claim 1, wherein said control means includes first auxiliary detecting means disposed rearwardly of said step-like obstruction and arranged to detect the front wheels of a vehicle negotiating said barrier in a reverse direction, whereupon to actuate said latch means to lock said platform in said raised position thereof, and second auxiliary detecting means disposed forwardly of said leading edge of said platform and operable by said rearmost wheels of said vehicle to release said latch means, thereby permitting unhindered flow of vehicles in said reverse direction.

8. A traffic barrier as claimed in claim 1, wherein said latch means comprises at least one solenoid-operated latch member mounted on said step-like obstruction and arranged to engage a cooperating detent on said platform, when said platform is in said raised position thereof.

9. A traffic barrier as claimed in claim 8, wherein said at least one latch member is controlled by two solenoid devices, one of which is adapted to advance said latch member into said locking position and the other of which is adapted to retract said first solenoid device and said latch member to said release position.

10. A traffic barrier as claimed in claim 1, including a fail-safe device adapted to actuate said latch means and lock said platform in said raised position thereof in the event of disconnection of the electrical supply.

11. A traffic barrier as claimed in claim 1, including a visual signal means associated with said barrier for producing a visible indication of whether said platform is locked in said raised position thereof and a vehicle is authorised to negotiate said barrier, said visual signal means comprising a visible barrier member mounted on said top of said step-like obstruction and operable by said control means to move into a visible position projecting above said obstruction, when said latch means is released, and to return to a substantially concealed and unobstructing position, when said latch means is actuated and a vehicle is permitted to negotiate said barrier.

12. A traffic barrier for controlling a flow of vehicles, comprising in combination:

(a) a step-like obstruction adapted to resist the advance of a vehicle, said step-like obstruction having a top and abutment means;

(b) a platform disposed in advance of said step-like obstruction and having a leading edge remote from said obstruction and a trailing edge adjacent said abutment means of said obstruction;

(c) hinge means mounting said platform for rocking movement between a lowered position and a raised position in which said trailing edge of said platform is adjacent said top of said step-like obstruction;

(d) means urging said platform into said raised position;

(e) said platform being depressible into said lowered position by a vehicle advancing over said platform from said leading to said trailing edge thereof, whereby said abutment means of said step-like obstruction is presented to said vehicle to resist advance thereof;

(f) latch means movable between a release position and a locking position in which said latch means locks said platform in said raised position, whereby to permit a vehicle to advance over said platform and said step-like obstruction; and (g) control means to control said latch means in response to advance of a vehicle relative to the barrier.

13. A traffic barrier for controlling a flow of vehicles, comprising in combination:

(a) a step-like obstruction adapted to resist the advance of a vehicle, said step-like obstruction having a top and abutment means extending downwardly from said top;

(b) a platform disposed in advance of said step-like obstruction and having a leading edge remote from said obstruction and a trailing edge adjacent said abutment means of said obstruction;

(c) hinge means mounting said platform for rocking movement between a lowered position and a raised position in which said trailing edge of said platform is adjacent said top of said step-like obstruction;

(d) means urging said platform into said raised position;

(e) said platform being depressible into said lowered position by a vehicle advancing over said platform from said leading to said trailing edge thereof, whereby said abutment means of said step-like obstruction is presented to said vehicle to resist advance thereof;

(f) latch means movable between a release position and a locking position in which said latch means locks said platform in said raised position, whereby to permit a vehicle to advance over said platform and said step-like obstruction;

(g) means adapted normally to urge said latch means into said locking position;

(h) control means selectively operable to actuate said latch means and retract said latch means into said release position;

(i) said control means being responsive to advance of a vehicle relative to the barrier.

14. A traffic barrier as claimed in claim 13, wherein said latch means is carried by said obstruction, and comprises at least one pivotally mounted latch member, spring means normally biasing said latch member to said locking position in which it engages detent means on said platform, and a solenoid device which, when actuated, retracts the latch member from said locking position to said release position in which it is disengaged from said detent means, against the biasing force of said spring means.

15. A traffic barrier as claimed in claim 13, wherein said means urging said platform into said raised position comprises at least one pair of opposed, semi-elliptical leaf springs, interconnected at their opposite ends, and being loaded intermediate their ends by said platform.

16. A traffic barrier as claimed in claim 13, wherein said step-like obstruction is adapted to project above an adjacent road surface, and said platform, when in said raised position thereof, is arranged as a ramp which leads from said road surface to said top of said obstruction, and wherein a fixed ramp is disposed on the opposite side of said obstruction from said platform and extends downwardly from said obstruction to said road surface in order to permit a vehicle to return to the normal road surface after it has negotiated said barrier.

17. A traffic barrier as claimed in claim 13, wherein said control means is responsive to advance of the front wheels of an unauthorised vehicle relative to said platform to release said latch means.

18. A traffic barrier as claimed in claim 17, wherein said control means includes a manually operable device positioned in advance of said platform and responsive to a prescribed action to inhibit release of said latch means responsive to advance relative to said platform of the front wheels of a vehicle authorised by said prescribed action, release of said latch means being enabled by means responsive to advance of wheels of said vehicle beyond said platform.

19. A traffic barrier as claimed in claim 18, wherein said control means includes detecting means comprising first actuating means disposed at or in advance of the leading edge of said platform, and actuable by the front wheels of a vehicle approaching said platform to actuate first switch means, means operable selectively to inhibit siad first switch means whereby actuation of said first switch means will not actuate and retract said latch means from said locking position, and to enable said first switch means whereby actuation of said first switch means will actuate and retract said latch means to said release position, further actuating means disposed rearwardly of said platform and actuable by the front wheels of a vehicle leaving said platform to actuate further switch means, actuation of said further switch means being operable to cause said inhibit/enable means to enable said first switch means.

20. A traffic barrier as claimed in claim 19, wherein said inhibit/enable means comprises switch means connected in series with said first switch means.

21. A traffic barrier as claimed in claim 19, wherein said further actuating means comprises second actuating means mounted on or rearwardly of said obstruction and operable to actuate second switch means, and third actuating means mounted rearwardly of said second actuating means and operable to actuate third switch means, actuation of said second switch means being operable to change said third switch means from an inhibited to an enabled state, actuation of said third switch means, when enabled, being operable to cause said inhibit/enable means to enable said first switch means.

* * * * *